United States Patent [19]

Schulman

[11] Patent Number: 4,852,195

[45] Date of Patent: Aug. 1, 1989

[54] FLUID PRESSURIZED CUSHION

[76] Inventor: David A. Schulman, 7701 Newton Ave. North, Brooklyn Park, Minn. 55444

[21] Appl. No.: 109,298

[22] Filed: Oct. 16, 1987

[51] Int. Cl.[4] ..... A61G 7/04; A47C 27/10

[52] U.S. Cl. ..... 5/453; 5/455; 297/DIG. 8

[58] Field of Search ..... 5/453, 455, 454, 456, 5/451, 449; 297/DIG. 3, DIG. 8

[56] References Cited

U.S. PATENT DOCUMENTS

| | | | |
|---|---|---|---|
| 1,353,260 | 9/1920 | Monks | 5/455 |
| 1,772,310 | 8/1930 | Hart . | |
| 2,434,641 | 1/1948 | Burns | 297/DIG. 3 |
| 3,008,465 | 11/1961 | Gal | 128/33 |
| 3,263,247 | 8/1966 | Knittel | 5/353 |
| 3,605,145 | 9/1971 | Grabbe . | |
| 3,870,450 | 3/1975 | Grabbe . | |
| 3,879,776 | 4/1975 | Solen | 5/453 |
| 3,919,730 | 11/1975 | Regan | 5/348 R |
| 4,005,236 | 1/1977 | Grabbe . | |
| 4,120,061 | 10/1978 | Clark | 297/DIG. 8 |
| 4,279,044 | 7/1981 | Douglas | 5/453 |
| 4,653,130 | 3/1987 | Senoue et al. | 5/453 |
| 4,662,012 | 5/1987 | Torbet | 5/453 |
| 4,737,998 | 4/1988 | Johnson | 5/451 |

FOREIGN PATENT DOCUMENTS

| | | | |
|---|---|---|---|
| 876760 | 7/1949 | Fed. Rep. of Germany | 5/456 |
| 2083865 | 12/1971 | France . | |
| 1341325 | 12/1973 | United Kingdom . | |

*Primary Examiner*—Alexander Grosz

*Attorney, Agent, or Firm*—James V. Harmon

[57] ABSTRACT

A hollow, air filled body support cushion such as a seat cushion or mattress is formed from typically three interfitting matrices each comprising a set of hollow cells formed from natural or synthetic rubber or rubber-like plastic. The cells of each matrix are spaced apart to accommodate between them cells of each of the other matrices to define a body support surface made up of the tops of all of the cells. Each matrix has separate fluid ducts between its cells. A fluid pressurizing and control means such as air pumps is used to inflate and deflate the matrices in sequence to shift body support from one set of cells to another for promoting blood circulation and enhancing comfort.

15 Claims, 4 Drawing Sheets

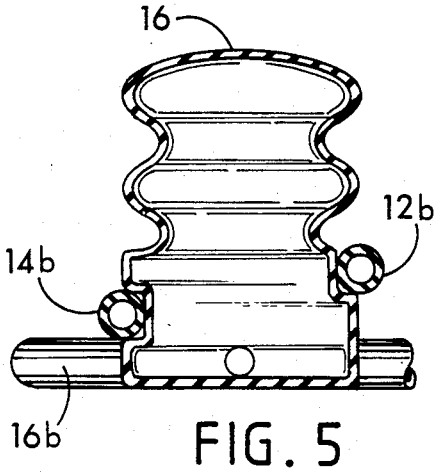
FIG. 5
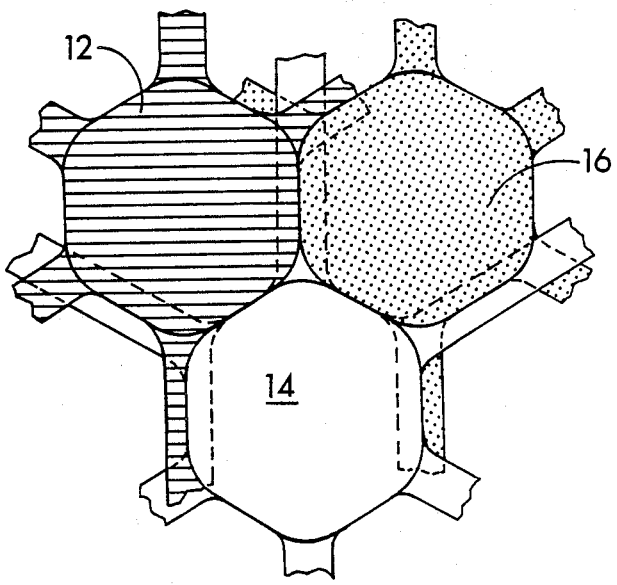
FIG. 6
FIG. 7
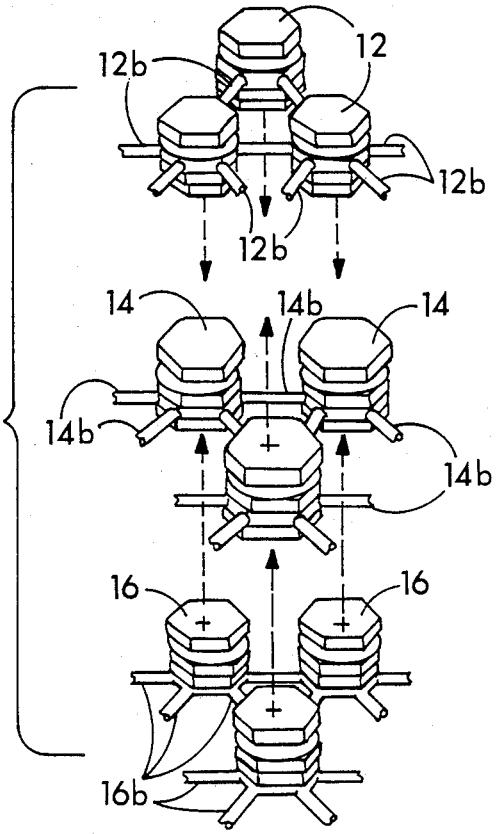

FLUID PRESSURIZED CUSHION

FIELD OF THE INVENTION

The present invention relates to automatic and passively pressurized seat or bed cushions having interconnected hollow body support cells.

BACKGROUND OF THE INVENTION

Numerous inflated cushions have been proposed for varying the air pressure in selected portions of a cushion to change the areas of support over a period of time to improve comfort and blood circulation. These devices have been used on beds and wheelchairs to forestall or reduce skin breakdown in immobile or elderly patients. Skin breakdown can occur (usually at bony locations) when prolonged and uninterrupted sitting pressure reduces blood circulation below the level required to sustain tissue life. Breakdowns also can occur when a cushion does not provide adequate ventilation and causes the skin to be excessively moist and warm for prolonged periods.

Prior inflated cushioning devices have provided either passive or dynamic support for the body. While prior inflated devices have been useful, they have had some shortcomings. In some devices a leak can cause the cushion to collapse, rendering it ineffective. Some cushioning devices are not thick enough to fully contact and support the user's body contours without bottoming out. When cushion inflation pressure is increased to prevent bottoming out, the ability of the cushion to conform closely to the user's skin is reduced. As the cushion becomes more firm, its benefit to the user decreases. But if the cushion is made thicker to improve conformability, it tends to become unsteady and difficult for persons with impaired body balance to use. Moreover, as the cushion becomes more conformable it becomes more difficult for ventilating air to reach the skin and keep it cool and dry and thus increases the risk from skin maceration.

At the present time there are cushioning devices available which will support the body horizontally at pressures of about 10 millimeters of mercury and provide adequate ventilation. The fluidized bed is a prime example of one such device. But even fluidized devices cannot provide effective support for seated individuals in wheelchairs because there is insufficient seating area to reduce support pressures to the level of 10 millimeters of mercury advocated in medical literature for spinal cord injured persons. Sitting pressures at bony locations can be ten or thirty times higher than this amount and, except for cushion intervention, are the usual places where skin breakdown begins.

Cushion interventions which reduce the risk of skin breakdown generally involve providing increased conformability to reduce average sitting pressure (air or fluid filled passive cushions), contouring surfaces to support the user on the fleshier and non-bony parts of the sitting area which are less likely to develop pressure sores (foam composition passive cushions), conformable cushions with high heat acceptance capacity intended to delay heat build-up in the sitting area (gel filled passive cushions), dynamic cushions which continually shift sitting pressure to different parts of the resting surface to allow blood circulation and air circulation to be restored to all parts of the sitting area (alternating pressure cushions).

Medical authorities are in general agreement that an ideal cushion should not cause prolonged impairment of blood circulation to the tissues in the sitting area, should not cause the skin to become hot and moist, should provide stable support with postural and transfer benefits, should provide comfort, durability and convenience at an affordable price.

In one form the present invention provides an alternating pressure cushion which has the foregoing benefits to wheelchair cushion users without the limitations of earlier devices and concepts. The invention can also be used as a highly beneficial passive cushion. Moreover, it will not bottom out even if punctured.

SUMMARY OF THE INVENTION

The present invention provides a hollow, fluid pressurized body support cushion formed from at least two and preferably three interfitting matrices Each matrix comprises a set of hollow cells formed from an elastomer such as natural or synthetic rubber or other resilient plastic material The cells of one matrix are fitted between the cells of each of the other matrices to define a body support surface composed of all sets of cells. Separate fluid ducts are provided between the cells in each matrix so that the cells of one matrix are connected only to the cells of the same matrix A fluid such as air is provided in the cells Optionally, a fluid pressurizing means is connected to each matrix to inflate and deflate the separate matrices at different times to shift body support from one set of cells to another to promote blood circulation and comfort. When the pressurizing means is not used the invention acts as a passive cushion.

DETAILED DESCRIPTION OF THE INVENTION

The present invention thus provides a cushion which can be used for a seat or bed which in addition to being very comfortable, yieldable and elastic allows the support points to be shifted from area to area. It can be made from a variety of resilient elastomers such as natural or synthetic rubber and operates automatically for as long as it is in use.

When the system is used as a dynamic support surface having automatic air inflation and deflation with three matrices present, two of the three matrices are pressurized at any given time and the third matrix is vented to the atmosphere. The vented matrix, one-third of the entire support surface, is unable to support any weight and so cannot exert any pressure on the body. Because the dynamic cushion supports the body on only two-thirds of its surface, cushion support pressures against the body are higher than if the entire surface of the cushion were used to support the body. However those higher pressures on the skin are relieved as the matrices are sequentially pressurized and vented automatically at regular intervals of about two minutes. Blood flow is restored to another third of the resting area each time another set of matrices is pressurized and vented.

It is possible to use the cushion of the present invention for passive support as well as for dynamic support. This is accomplished by admitting and retaining an appropriate amount of air by means of a valve which is fitted in each matrix for this purpose. When a body rests on the cushion, the air inside each matrix is forced from cells which are subjected to higher compressive forces to cells which are subjected to lesser external forces. Because the air inside a matrix of cells is at the same pressure, all cells in the same matrix support the external load with equal pressure.

Although passive cushions strive to maximize their load carrying area, all passive cushions develop excessive pressure and restrict blood circulation. Because passive cushion pressures are unrelieved and prolonged, blood flow is reduced and is not restored. Average passive cushion pressures (about 50 millimeters of mercury) significantly exceed recommended values for unrelieved support pressure (30 mmHg for non-paralyzed persons; 10 mmHg for paralyzed persons). However, many users of wheelchair cushions prefer passive cushions to dynamic cushions if they can shift or lift themselves periodically to relieve sitting pressure. This exertion helps them to avoid immobility deterioration. Furthermore, passive cushions are generally less expensive and somewhat more convenient to use than dynamic cushions. However, aging and a relatively immobile lifestyle eventually force wheelchair users to use better cushions or to spend more time in bed in order to avoid skin breakdown.

The decision to use a passive or alternating pressure cushion is based on medical and economic factors which keep changing with the patient's health and economic status. An important benefit of the present invention is to make available a single superior passive cushion which can become a superior alternating pressure cushion at any time by simply connecting it to a controlled air module which operates from its own battery or from a wheelchair battery. It is less costly to upgrade from passive to dynamic support because the same cushion can be used; only the alternating air pressure module needs to be added. No support system currently in commercial use offers this benefit.

When used as a passive cushion, the present invention supports the user on three independent air matrices. If one matrix should develop a leak or be punctured, the user will not bottom out because his weight will be supported by the two remaining matrices. When other types of passive inflated cushions develop a leak or sustain a puncture, they allow the user to bottom out. If the patient is paralyzed or is not aware of the leak, he continues to sit on the deflated cushion and often sustains tissue damage or breakdown. The ability of the present invention to keep the user from bottoming out is an important safety benefit not available in other inflated cushions.

Because each matrix of cells in the present invention is an independent structure adjacent but not connected to the other matrices, ambient air can circulate to the resting area, i.e., patient support surface, and remove heat and humidity. Other cushion types have continuous support surfaces which restrict or prevent air circulation. An important benefit of the present invention is its ability to keep the user's skin cooler and drier. The importance of keeping the skin at normal temperature and humidity is of major concern in medical cushions. Passive cushions as a group are single-surface thermal insulators and do not permit air to communicate easily with the resting surface. The present invention is a multiple surface device which affords more opportunity for ambient air to circulate through the space surrounding each free-standing cell and reach the resting surface to carry away heat and humidity. When the present invention is used as a dynamic cushion the air circulation benefit increases.

If the present invention should require servicing or repair, the matrix that requires attention can be manually disengaged from the other matrices and a new matrix inserted in its place without complication or special tools. In addition to the speed and convenience of servicing, it is less costly to replace or repair one-third of a cushion than it is to replace an entire cushion.

Stable support and minimum thickness are additional desirable attributes in cushions when the user's balance is impaired, or when the cushion is to be used in a van where headroom is limited and cushion sway can affect the driver's control. Transfers to and from the cushion become more difficult when the cushion is unsteady. The present invention minimizes these problems by a two-level cell design. The lower portions of the cells interlock to constitute a stable base and the upper portions of the cells are individual bellows which conform closely to the body contours and move up or down to maintain uniform support pressure. When a bellows is compressed, it moves axially in a vertical direction and does not balloon outward. The bellows portion of the cell displaces only the distance needed to follow the body's contours. A prior device described in U.S. Pat. No. 3,870,450 has cells which are more widely spaced and which must balloon outwards to contact adjacent cells before they can develop a supporting surface. In that system the cell walls are fluted and the cell height is increased to allow for ballooning. That support has a rolling action and offers little or no resistance to sideways forces. It causes users to feel unsteady during sliding transfers onto or off the cushion or when experiencing changes in motion in vehicles.

The device described in U.S. Pat. No. 3,870,450 and in related U.S. Pat. Nos. 4,005,236 and 3,605,145 has significant limiting differences with respect to the present invention because all cells are interconnected whereas in one form of the present invention at least two independent configurations of cells or cell matrices are provided to constitute a body support. The prior device cannot provide alternating pressure support because it is only a single plenum. The prior device is inherently unstable because its cells cannot be positioned closely (following the techniques and reasoning presented in the patents). The wider spacing between these cells requires the cells to have enough volume and lateral extensibility to fill the spaces between the cells before the cells can begin to support the user. A pump is provided and care must be taken to not overinflate (or the support will be too firm for maximum conformability) or underinflate (or the user will bottom out). The cells of the present invention when assembled are in close proximity and immediately support the user's body weight without first laterally deforming and becoming unsteady.

These prior devices are manufactured by dip molding and require a number of careful manufacturing operations including the joining, without leaks, of the base section to the upper section along a long bond line. The present invention may be manufactured by rotational molding, whereby each matrix is molded complete without need for secondary operations except for valve assembly. The present invention is less costly to manufacture than prior designs and thus represents economic benefit to the purchaser.

The present invention when used as a passive cushion does not require a pump for inflation. When the valve in each matrix of cells is vented to atmosphere, the self-supporting molded shape of the cells causes the cells to retain their molded shape. When the valves are closed, the cells are at full height and at ambient pressure and are ready to operate without user adjustment. This simple procedure permits the cushion to quickly and accurately adapt to operation at various altitudes. Other inflatable cushions do not have the present invention's ability to self-inflate or self-adjust.

The invention will now be described by reference to the figures.

THE FIGURES

Figure 4:
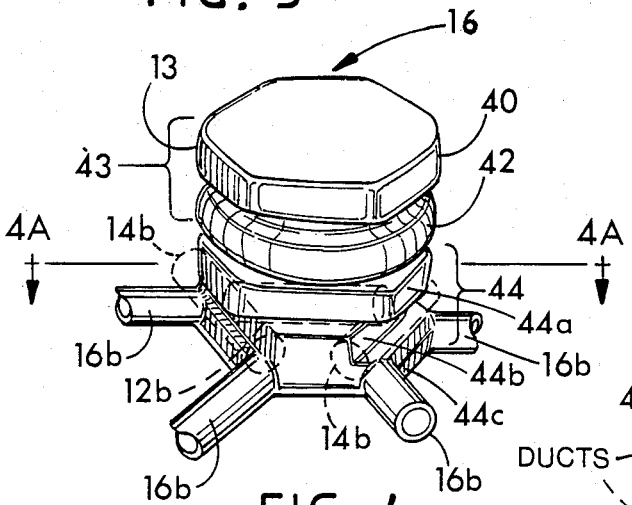
FIG. 4 is a perspective view of one cell.
Figure 4A:
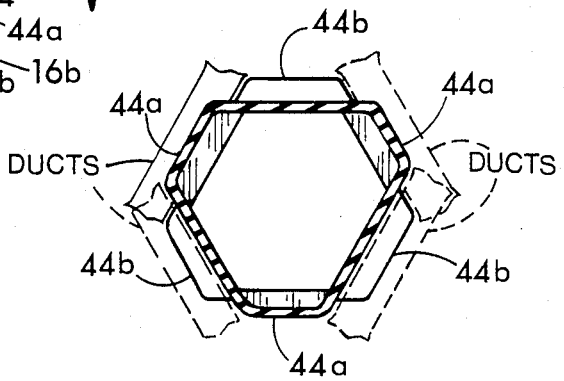

FIG. 4*a* is a view taken along lines 4*a*—4*a* of FIG. 4.

FIG. 5 is a vertical cross-sectional view of a cell.

FIG. 6 is a plan view of a portion of a cushion showing three adjacent cells.

FIG. 7 is an exploded view of a portion of a cushion showing three interfitting matrices.

Figure 8:
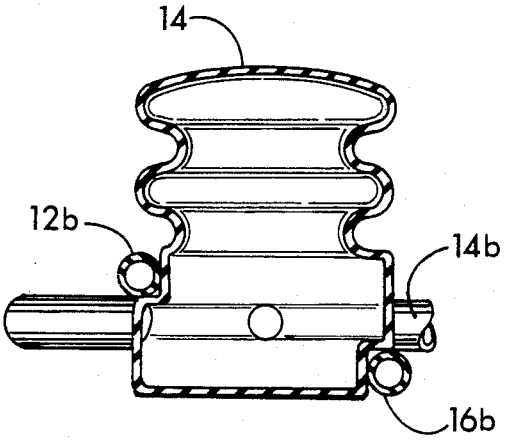

FIG. 8 is a vertical cross-sectional view of the intermediate matrix.

Figure 9:
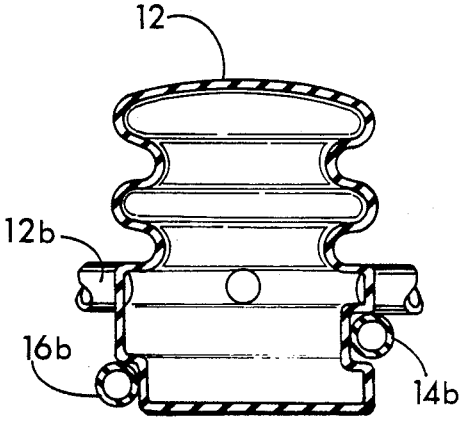

FIG. 9 is a vertical cross sectional view of the uppermost matrix and

Figure 2:
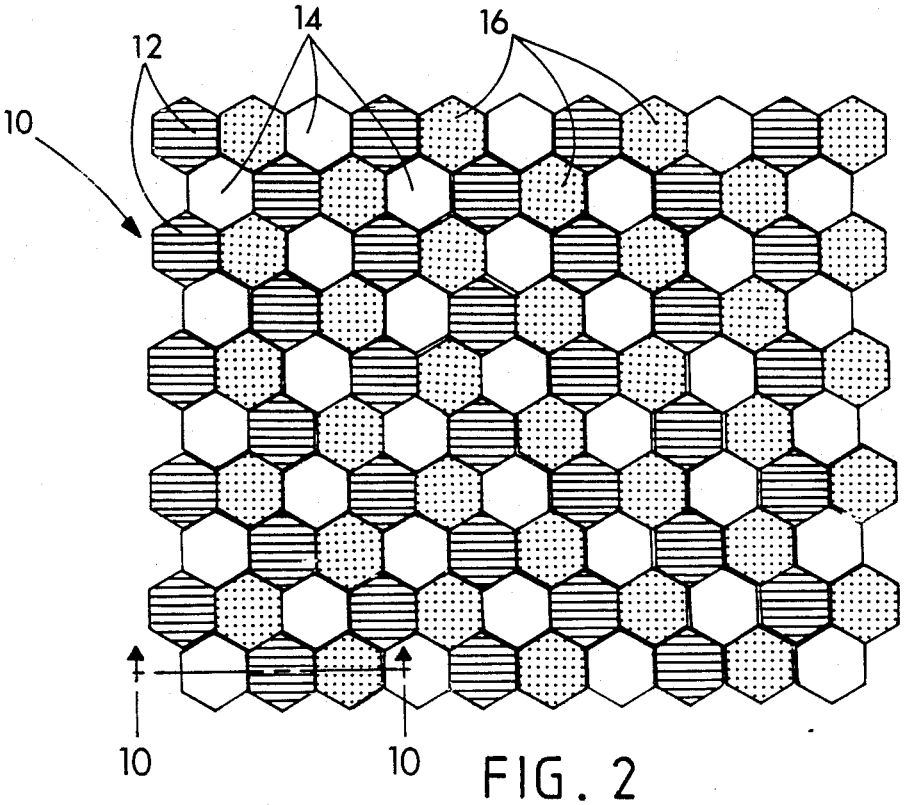
FIG. 2 is a plan view of the cushion of FIG. 1.
Figure 10:
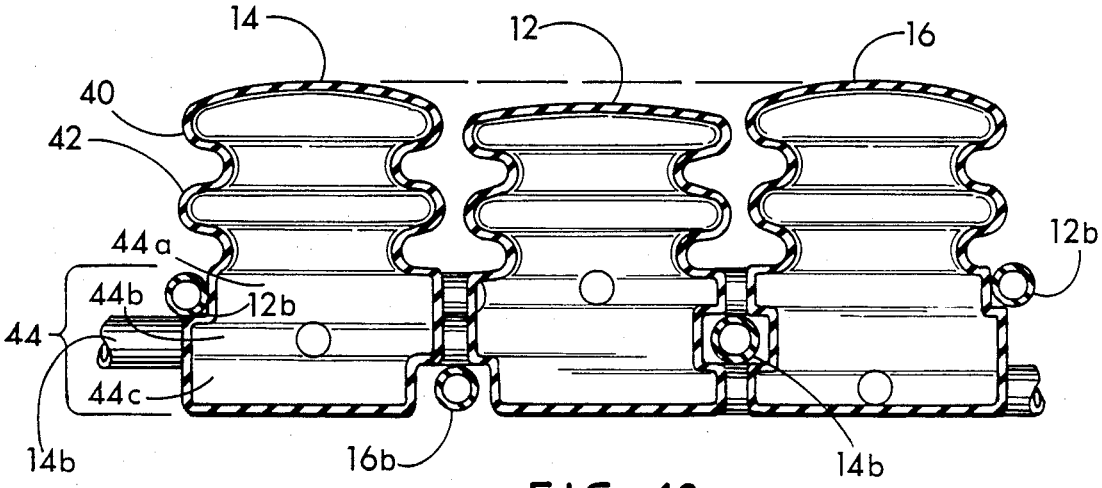

FIG. 10 is a vertical sectional view showing three adjacent cells of a cushion taken on line 10—10 of FIG. 2.

DESCRIPTION OF A PREFERRED EMBODIMENT

Figure 1:
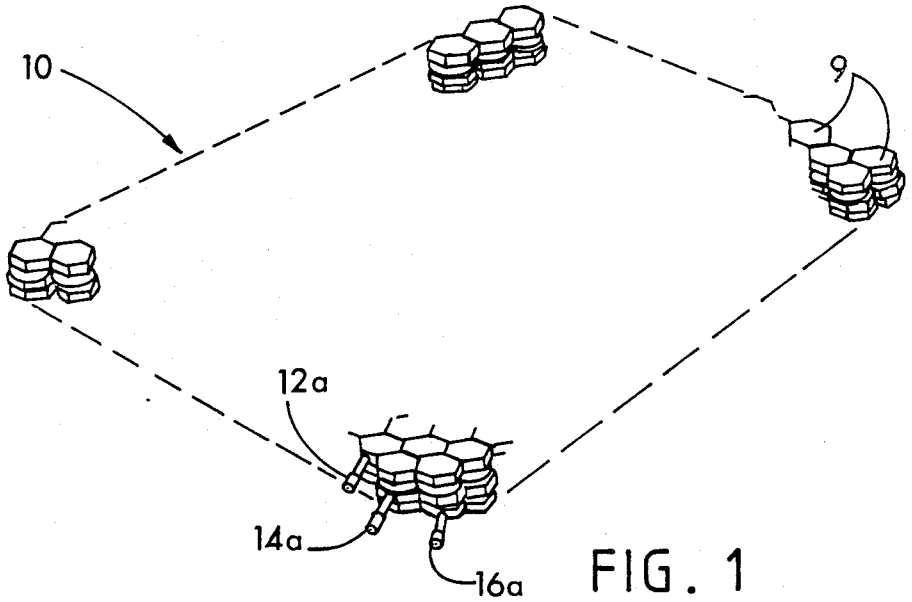
FIG. 1 is a perspective view of one preferred form of the invention.
Figure 3:
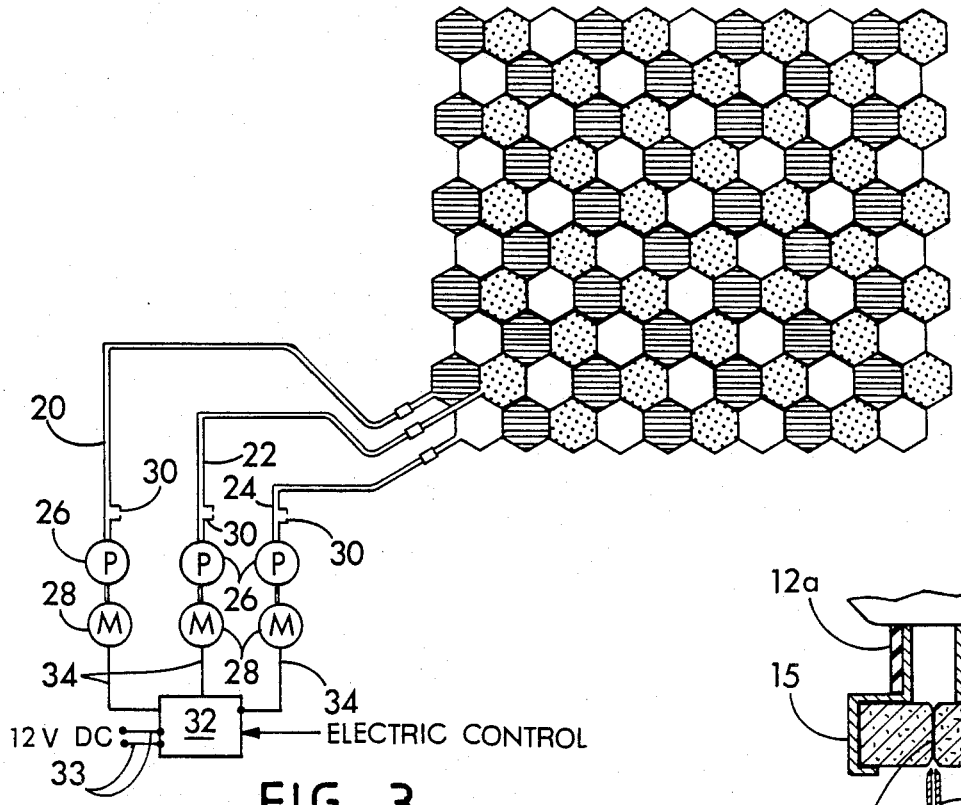
FIG. 3 is a schematic view of a cushion and its fluid pressurizing unit.

In FIGS. 1–3 is shown a cushion 10 made up of a plurality of cell matrices 12, 14 and 16 interfitted between or among one another to produce a supporting surface 9 for all or a part of the human body. The cushion 10 can be suitable as a seat cushion or bed cushion. It can also be used as the back of a seat or for supporting other portions of the human body. Each of the cells 12, 14 and 16 are hexagonal in plan view as seen from above. Thus they each form an array connected together by ducts to be described below with spaces between the cells of each matrix sufficient to accommodate the cells of two other matrices. The invention is used as shown in FIG. 1 without an air pressurizing means, such as an air pump, to provide a passive cushion.

In FIGS. 2 and 3, for convenience, the cells of matrix 12 are all indicated by horizontal cross-hatching, the cells 14 are clear and the cells 16 are designated by stippling so that the arrangement of the cells in each matrix relative to the others can be clearly seen.

Figure 3A:
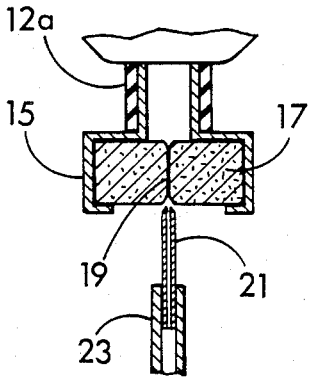
FIG. 3A is a view of a preferred form of air inlet valve.

As can be seen by reference to FIGS. 4–7, the cells of each matrix 12 are connected by interconnecting ducts 12*b*, the cells 14 by interconnecting ducts 14*b* and the cells 16 by interconnecting ducts 16*b*. Thus each set of cells has its own connecting ducts so that a separate air supply can be provided to each matrix 12–16, i.e. a separate set of cells. As shown in FIGS. 1 and 3, air is supplied to the matrix 12 through an air supply duct valve 12*a*. Air is supplied to the matrix 14 through an air supply duct 14*a* and to matrix 16 through air supply duct 16*a*. Each of the ducts 12*a*–16*a* as shown in FIG. 3A has at its end an air supply valve 15 of a type known to the art containing a rubber plug 17 having a self-sealing opening 19 which is normally closed but which during use is adapted to receive a hollow needle 21 connected to a fluid supply tube 23. While any suitable fluid can be used in connection with the invention it is preferred to employ air.

As shown in FIG. 3, which illustrates dynamic air pressurization, air is provided through supply ducts 20, 22 and 24 to the inlet duct 12*a*–16*a* from three separate pumps 26, each driven by an electric motor 28 connected to an electric operating control 32 which is itself connected via conductors 33 to a suitable source of power such as a battery (not shown). Each of the lines 20–24 is provided with a bleed valve 30 that allows air to escape slowly through a bleed hole. Thus when each one of the pumps is operating it will quickly fill up the matrix to which it is connected and maintain the desired internal pressure. However, as soon as the electric control turns off one of the motors 28, air in that matrix will escape through the bleed hole 30 over a period of, say, one minute until atmospheric pressure is reached within that matrix. Typically, two matrices are maintained pressurized at all times and one is unpressurized. Every two minutes pressure is released from one of the other matrices and the unpressurized matrix is inflated.

The individual cells will now be described with reference to FIGS. 4, 5 and 8–10. As can be seen in FIG. 4 each cell of matrix 12 is composed of a pair of upper bellows compartments 40 and 42 above one another which expand and contract vertically during use and during inflation and deflation. Between compartments 40 and 42 is a constricted neck portion of a smaller diameter than compartments 40 and 42 Together the upper compartments of cells 40 and 42 and the neck between them make up a bellows 43. The top compartment 40 of the bellows 43 has a generally hexagonal shape as seen from above with somewhat rounded corners for improved ventilation. The lower bellows compartment 42 has a circular cross-section as seen from above. It is doughnut-shaped with a convex wall. Below the bellows portion 43 is a pedestal portion 44 made up of three vertically aligned hexagonal sections 44*a* at the top, 44*b* at the center and 44*c* at the bottom. Alternate walls of the pedestal portions 44*a*–44*c* are of shorter and longer lengths to accommodate the ducts of adjacent cells as shown in FIG. 4A. The ducts 12*b* and 14*b* accommodated between the pedestals sections 44*a* and 44*b* are clearly shown in FIG. 4. The relative locations of the connected ducts surrounding each cell is shown in FIG. 6.

FIG. 7 which shows an exploded view of one portion of a cushion illustrates how three separate matrices, each having ducts 12*b*, 14*b*, and 16*b* at a different elevation, can be separated from one another and are fitted together during assembly to provide a complete cushion. First, the matrix 14 with the intermediate connecting ducts 14*b* which extend laterally from the pedestal section 44*b* is pressed downwardly onto the matrix 16 having ducts 16*b* lowermost. Next the matrix 12 having ducts 12*b* that extend from the uppermost pedestal section 44*a* is pressed downwardly into the remaining openings until the ducts 12*b* are accommodated between the adjacent walls of the pedestal section 44*a*.

Once the three matrices 12, 14 and 16 have been thus combined a complete cushion 10 is formed. The air supply ducts 12*a*–16*a* are then connected to the supply tubes 20–24 and the electric controller is turned on to operate two of the motors 28 while the other motor 28 is sequentially stopped for a period of say, two minutes. The cycle is repeated causing each one of the matrices 12–16 to sequentially be deflated for a period of two minutes while the others are inflated throughout the cycle of operation thereby sequential shifting support from one portion of the body to another throughout operation.

The cells are formed from a flexible but self-supporting molded elastomer having sufficient body to hold its molded shape when the interior is vented to the atmosphere with no weight thereon. The cells become a passive cushion when the matrix is sealed to the atmosphere. One self-supporting cell can be made, for example, of polyvinylchloride plastisol elastomer suitable for rotational molding and having a wall thickness of about 0.050" and a Shore durometer value of about 50 (A Scale).

The invention can be applied to a different number of matrices. For example, if two or four matrices are used, the top portion of each cell is preferably square in shape rather than hexagonal.

Many variations of the invention within the scope of the appended claims will be apparent to those skilled in the art once the principles described herein are understood.

What is claimed is:

1. A hollow, fluid pressurized, body support cushion formed from a plurality of interfitting matrices, each such matrix comprising a set of hollow cells formed from a resilient elastomeric material, the cells of one matrix being fitted between the cells of each other such matrix to define a body support surface composed of all sets of cells, separate interconnecting fluid ducts between the cells in each matrix, fluid pressurizing means to inflate and deflate the separate matrices at different times to shift body support from one set of cells to another for promoting blood circulation and enhancing comfort for the user, and said plurality including matrices, each having cells arranged in an array with spaces between cells of each matrix of the same size as the cells of other matrices to accommodate the cells of an adjacent matrix so that when the said matrices are interfitted together a complete cushion is formed having an upper supporting surface defined by adjacent top portions of all the matrices and the ducts of each matrix are positioned at a different elevation to allow the matrices to be nested together.

2. The cushion of claim 1 wherein each cushion is composed of cells comprising an upper hollow bellows portion and a lower hollow pedestal portion and the interconnecting ducts extend between the pedestal portions of the cells in the same matrix.

3. The cushion of claim 1 wherein each cushion comprises a plurality of spaced apart cells, the spacing between the cells being sufficient to accommodate the cells of the other matrices whereby the cells of each matrix are interfitted between the cells of another matrix.

4. The cushion of claim 1 wherein each cell of each matrix includes an upper vertically expandable bellows portion and a lower less expandable pedestal portion, each pedestal portion includes an upper, an intermediate and a lower portion and the ducts of one matrix are all connected to the lower portion of the pedestal, the ducts of an intermediate matrix are all connected to an intermediate portion of the pedestal and the ducts of a third matrix are all connected to the upper portion of the pedestal.

5. The cushion of claim 4 wherein the top portion of the bellows section of each cell is generally hexagonal as seen from above and a second lower portion of each bellows has a generally circular configuration.

6. The apparatus of claim 1 wherein an air supply is connected to the cushion, said air supply includes air pressurizing means and timing means for alternately inflating and deflating selected ones of said matrices.

7. The apparatus of claim 6 wherein the air pressurizing means comprises an inflation means for each of said cushions, motor means for operating each of said inflation means and a control means for selectively operating said motors whereby when three matrices are provided two motors are operated simultaneously to inflate two of said matrices while the other motor is turned off and each motor is turned off in sequence to sequentially deflate one matrix at a time.

8. The cushion of claim 1 which is self-inflating when vented to the atmosphere and is self-adjusting in volume due to the self-supporting shape and consistency of the cells whereby no pump is required for volume adjustment.

9. The cushion of claim 1 wherein said cells have an upper portion of polygonal shape including corners, and said corners are rounded to enhance ventilation of a seating area.

10. The cushion of claim 1 wherein at least some of said cells comprise a vertically extensible bellows having at least two bellows compartments of a selected diameter and a centrally constricted neck portion of a smaller diameter therebetween.

11. A hollow, fluid pressurized body support cushion formed from a plurality of interfitting matrices, each such matrix comprising a set of hollow cells formed from a resilient elastomeric material, the cells of one matrix being fitted between the cells of each other such matrix to define a body support surface composed of all sets of cells, separate interconnecting fluid ducts between the cells in each matrix, said cells including an upper hollow bellows portion and a lower hollow stabilizing pedestal portion and the interconnecting ducts extend between the pedestal portions of the cells in the same matrix for holding the cells of adjacent matrices in place and thereby provide steadiness to the cushion, said bellows portion including a pair of vertically disposed chambers, the upper one of which has a generally polygonal configuration, the lower one of which has a generally circular configuration and said pedestal comprises a plurality of vertically aligned hollow polygonal sections with alternate side edges longer than side edges intermediate to accommodate said ducts of an adjacent matrix, and fluid pressurizing means to inflate and deflate the separate matrices at different times to shift body support from one set of cells to another for promoting blood circulation and enhancing comfort for the user.

12. A fluid pressurized body support cushion comprising, a plurality of matrices, each matrix of said plurality including a plurality of inflatable bellows, bellows of a matrix being interconnected in pressured fluid flow communication to a source of a pressurized fluid with pressurization of each matrix being separate from pressurization of other matrices of said plurality, said matrices being interfitted to form said cushion with upper surfaces of said bellows defining a generally continuous cushion support surface and with contiguous bellows on said surface being interconnected to different matrices whereby each bellows of a matrix, in central areas of the cushion, is completely surrounded, at its upper periphery, by bellows of other matrices.

13. A cushion according to claim 12 where each bellows of said cushion is disposed in generally parallel side-by-side alignment extending from a pedestal portion to said upper surfaces, bellows of a same matrix interconnected by a plurality of fluid conduits extending between pedestals of bellows of said same matrix, pedestals of adjacent bellows of said cushion having surfaces in close proximity with one another and including indentations cooperating to define a plurality of conduit passageways disposed and sized to receive said conduits when said matrices are interconnected to form said cushion.

14. The inflatable device of claim 12 wherein three sets of bellows making up three sets of matrices are provided, with the bellows of each matrix fitted between the bellows of the other two matrices so that the sides of the bellows are positioned adjacent to one another whereby each bellows is supported in part by surrounding bellows and the tops of adjacent bellows are adapted to move independently along a vertical bellows axis.

15. A hollow, fluid pressurized body support cushion comprising, a plurality of interfitting matrices, each matrix comprising a set of hollow cells formed from a resilient elastomeric material and including a lower hollow stabilizing pedestal portion positioned in contact or close to the pedestals of an adjacent matrix, each matrix extending the full width and length of said cushion, each matrix including hollow inflation tubes connected between said hollow cells for transferring fluid therebetween, said inflation tubes extending laterally and longitudinally throughout the width and length of each matrix to hold the cells of each matrix in spaced apart relationship to form a self-supporting two-dimensional array of spaced cells, said inflation tubes of each matrix defining openings between themselves to receive the stabilizing pedestal portions of another of said matrices so that when the matrices are assembled the cells of each matrix are interlocked between the inflation tubes of another matrix and said interlocking of the cells of each matrix between the inflation tubes of another matrix constitutes a stable base for said cushion in which each cell is surrounded by a ring of inflation tubes to support the pedestals of the cells in a stable spatial relationship.

* * * * *